US011511910B1

(12) United States Patent
Bontrager et al.

(10) Patent No.: US 11,511,910 B1
(45) Date of Patent: Nov. 29, 2022

(54) NESTABLE TRAYS WITH MINIMUM AXIAL SPACING

(71) Applicant: Rev1 LLC, Austin, TX (US)

(72) Inventors: Rick Bontrager, Indio, CA (US); Randy Strange, Manteca, CA (US)

(73) Assignee: REV 1, LLC, Austin, TX (US)

( * ) Notice: Subject to any disclaimer, the term of this patent is extended or adjusted under 35 U.S.C. 154(b) by 0 days.

(21) Appl. No.: 17/513,704

(22) Filed: Oct. 28, 2021

(51) Int. Cl.
*B65D 21/02* (2006.01)
*B65D 1/34* (2006.01)

(52) U.S. Cl.
CPC ..... *B65D 21/0233* (2013.01); *B65D 1/34* (2013.01); *B65D 21/0209* (2013.01); *B65D 21/0212* (2013.01); *B65D 21/0216* (2013.01); *B65D 21/0215* (2013.01); *B65D 2581/053* (2013.01)

(58) Field of Classification Search
CPC ..... B65D 21/0233; B65D 1/34; B65D 21/04; B65D 21/048; B65D 2581/053; B65D 21/0209; B65D 21/0212; B65D 21/0215; B65D 21/0216
USPC ..... 206/519
See application file for complete search history.

(56) References Cited

U.S. PATENT DOCUMENTS 2,695,115 A * 11/1954 Roop ..... B65D 21/0219 206/508
3,117,692 A * 1/1964 Carpenter ..... B65D 43/0212 206/508
4,804,092 A 2/1989 Jones
4,826,039 A 5/1989 Landis
4,967,908 A * 11/1990 Kessler ..... B65D 21/0233 206/506
5,377,861 A 1/1995 Landis
6,213,301 B1 4/2001 Landis et al.
6,325,213 B1 12/2001 Landis, II
6,671,578 B1 12/2003 D'Amelio et al.
D737,680 S 9/2015 Breton et al.
9,725,210 B2 8/2017 Wnek et al.
10,077,134 B2 9/2018 Wnek et al.
2011/0139660 A1* 6/2011 Cabell ..... B65D 21/048 156/212
2018/0030659 A1* 2/2018 Chung ..... D21H 11/12

* cited by examiner

*Primary Examiner* — Don M Anderson
*Assistant Examiner* — Jennifer Castriotta
(74) *Attorney, Agent, or Firm* — SoCal IP Law Group LLP; Guy Cumberbatch

(57) ABSTRACT

A molded container of solid continuous construction having a floor and contiguous upstanding sidewalls angling outward and upward to a surrounding upper lip. Below the upper lip the floor and sidewalls surround an inner cavity adapted to receive food. The sidewalls include at least three outwardly-directed lugs that are thicker from an inner surface to an outer surface thereof than a nominal wall thickness of the remainder of the sidewalls. The sidewall at the location of each lug having an inner surface which is contiguous and uninterrupted relative to the inner surface of adjacent portions of the sidewall. Consequently, a first container may be stacked and nested within a second container such that the lugs on the first container contact the inner surface of the second container at the location of the lugs on the second container and maintain a predetermined axial spacing between the first and second containers.

15 Claims, 16 Drawing Sheets

NESTABLE TRAYS WITH MINIMUM AXIAL SPACING

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

Field

This disclosure relates to tray containers and, in particular, to tray containers that can be stacked in various orientations while maintain a minimum axial spacing.

Description of the Related Art

One area where the use of tray containers has become widespread is in the food packaging industry, in particular for meat products. Accordingly, it is common for these food containers to serve as the end display package in which the product is presented for sale to the customer in a tray with plastic wrap over the top lip. Pressed tray containers have been used in numerous environments for many years, with the containers having a common configuration that allows nested stacking of the containers. Conventional pressed paperboard trays and plate containers, for example, may have downwardly and inwardly converging sidewalls that are contiguous with a flat bottom wall, and with a radially extending lip along its top edge. This configuration allows pressed plates or trays to be nested in a stack of trays of the same configuration after formation for shipping and prior to filling with food.

One useful characteristic of tray containers is the ability to stack with uniform axial spacing between the container parts so that while stacked, adjacent parts do not become jammed or wedged together. Maintaining uniform gap spacing is also important to allow high-speed automated packaging equipment to separate and position individual containers from a nested group for automatic filling. Various rib or lug structures have been employed with lids to provide the requisite spacing, see e.g., U.S. Pat. Nos. 4,826,039 and 5,377,861.

One means for maintaining container spacing includes molded lugs which project inwardly or outwardly relative to the floor or skirt walls and contact the next adjacent container to keep the two containers axially spaced. However, if the lugs in two adjacent containers are mirror images of each other when nested they also nest, thus defeating the purpose of the lugs. To solve that issue, the lugs may be formed in a non-symmetric fashion and adjacent trays rotated so that the lugs in each do not align. This is a cumbersome process which adds expense.

Despite numerous attempts at providing nesting tray containers which maintain a certain axial spacing, there remains a need for trays that do not need special handling and can be stacked in various orientations.

SUMMARY OF THE INVENTION

According to exemplary embodiments, trays are provided which may be nested and maintain a minimum spacing between individual trays to enable ease of separation.

Other features and characteristics of the present invention, as well as the methods of operation, functions of related elements of structure and the combination of parts, and economies of manufacture, will become more apparent upon consideration of the following description and the appended claims with reference to the accompanying drawings, all of which form a part of this specification, wherein like reference numerals designate corresponding parts in the various figures.

DETAILED DESCRIPTION

Figure 1:
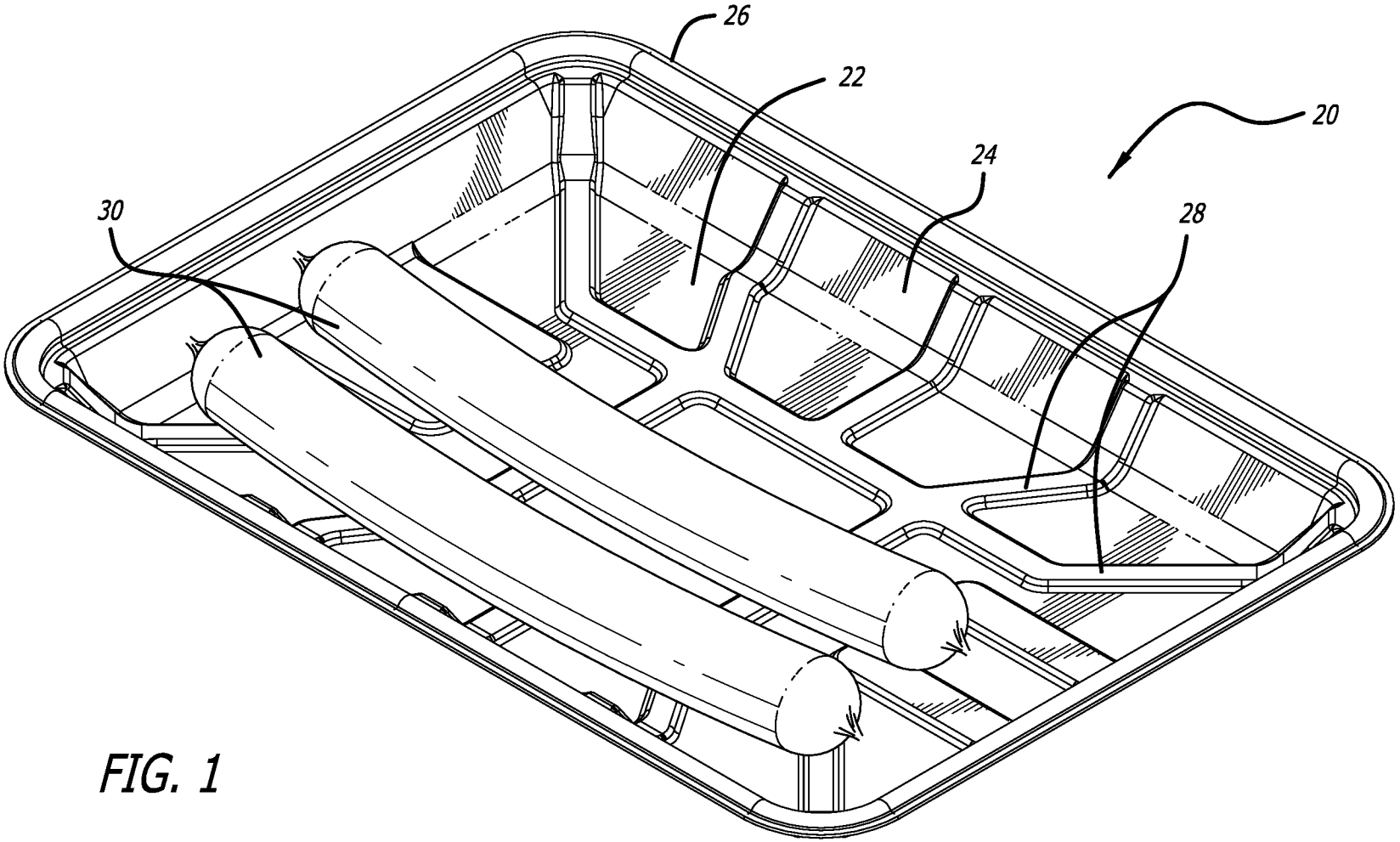
FIG. 1 is a perspective view from above of an exemplary rectangular food tray container of the present application.

The present application provides an improved food storage tray that may be stacked and nested with a plurality of identical food storage trays while maintaining a minimum axial spacing therebetween. The food storage trays illustrated herein have a floor connected to contiguous sidewalls extending around a continuous periphery, with no vent holes in the trays. However, vent holes are not excluded in certain situations. The sidewalls are relatively short in height so that the trays are somewhat shallow, preferable for containing meat products. However, the concepts described herein could be utilized in a variety of sizes and shapes of containers, and the claim should not be considered limited to shallow trays. Finally, two exemplary rectangular storage trays are illustrated and described herein as typical for use in the food industry. However, the rectangular peripheral shape is but one configuration, and the trays may be square, round, or various other polygonal or geometric shapes.

Generally, embodiments of the present invention are stackable, denestable trays, plates or other containers having features that facilitate denesting or manual separation of the containers when stacked. The embodiments described in this specification are generally referred to as "containers," which includes trays, plates, and other stackable products. The containers are typically formed from paperboard or pressed or molded fiber, although alternate embodiments may include containers formed from a variety of other compostable or otherwise easily biodegradable materials. Suitable materials include, for example, microwave susceptor laminated paperboard, dual ovenable coated or laminated paperboard, acrylic release coated paperboard, and polymer extrusion coated paperboard. Indeed, although the packaging industry has been moving towards biodegradable materials, the food storage trays disclosed herein could be formed of conventional plastics. Moreover, although the storage trays are particularly useful for holding food products, they may be utilized in other contexts.

The processes for forming food tray containers as disclosed herein include various forms of wet press molding of fibrous material. "Wet press" involves a starting slurry of about 95% water and 5% fibrous matter and chemicals. A dip mold having the final shape of the container is dipped into the slurry from above. The dip mold has a mesh or otherwise porous surface through which a suction is pulled to apply a negative pressure to the slurry. The fibrous matter is thus sucked onto the bottom of the dip mold and confirms to its contours. Subsequently, while maintaining the suction, the dip mold is translated over a cold press which has the shape of the dip mold but in a mirror image to conform thereto. Bringing the dip mold and cold press together flattens the fibrous material therebetween and presses out most of the remaining water. Subsequently, the molded fibrous material is dried further, often with heat, until the final container results. The wet press process is used for many products formed from fibrous often recycled materials, including eggs cartons and wine bottle shipping pallets, for example. It should be understood that the wet press process cannot create intricate molded shapes, as with other molding processes such as injection or spin molding.

Figure 2:
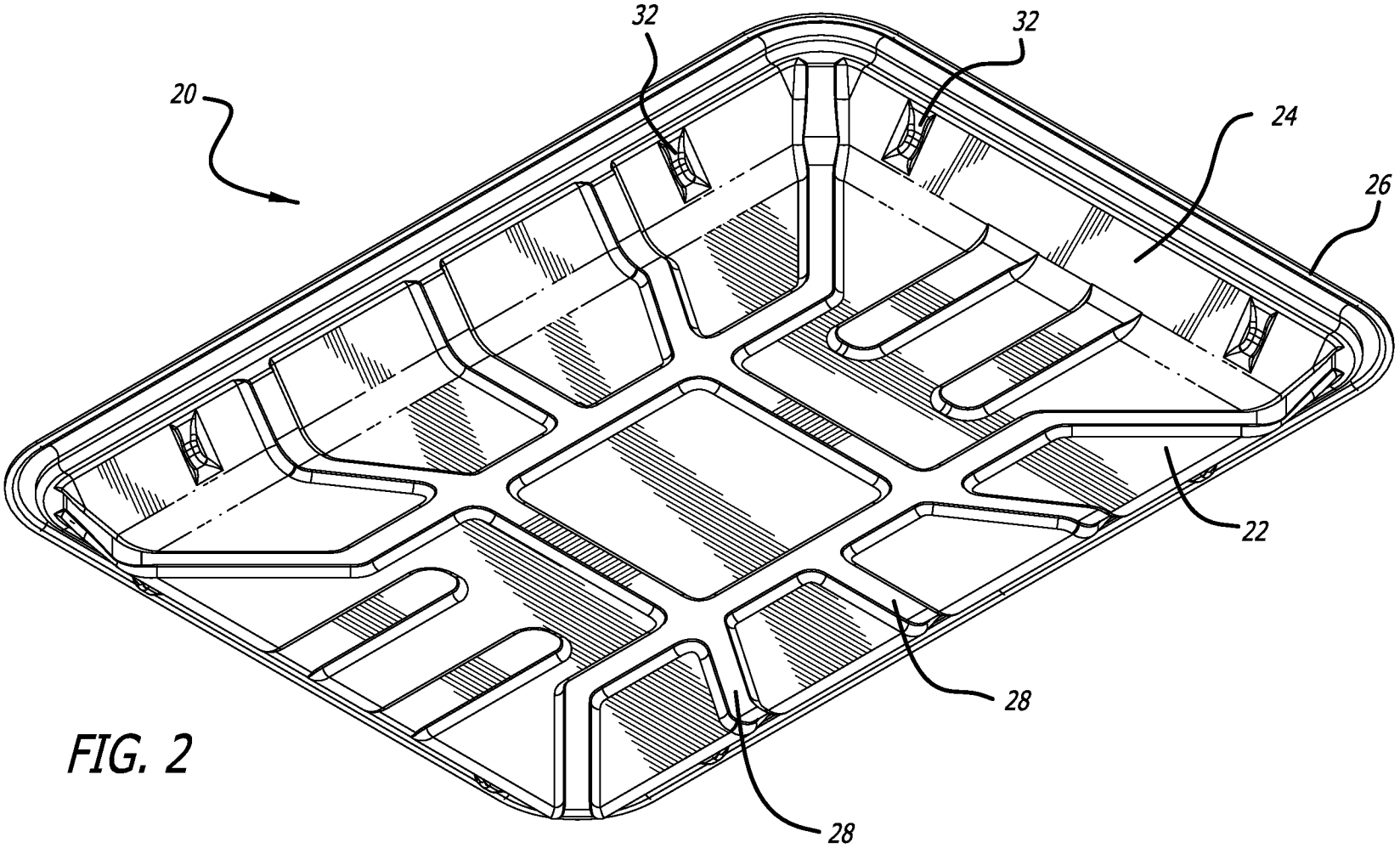
FIG. 2 is a perspective view of the food tray container from below.

FIG. 1 is a perspective view from above of an exemplary rectangular food tray container 20 of the present application, and FIG. 2 is a perspective view of the food tray container from below. As mentioned, the container 20 may have a relatively shallow configuration with a generally horizontal floor 22 and peripheral sidewalls 24 leading to a surrounding lip 26. In most embodiments, reinforcing ribs 28 are molded in various patterns across the floor 22 and of the sidewalls 24 for stiffness. The container 20 is shown with two hot dogs or sausages 30 placed therein for context.

The container 20 as a rectangular configuration with a length dimension perpendicular to a shorter width dimension. The floor 22 being generally horizontal defines a vertical axis, or up and down within the tray. A generally rectangular cavity is thus formed within the sidewalls 24 and below the surrounding lip 26.

With reference to the underside of the container 20, a plurality of outwardly projecting lugs 32 are provided in each of the sidewalls 24 that serve to maintain an axial distance between a series of stacked containers 20. In the illustrated embodiment, there are two spaced apart lugs 32 provided on each of the four sidewalls 24

Figure 3A:
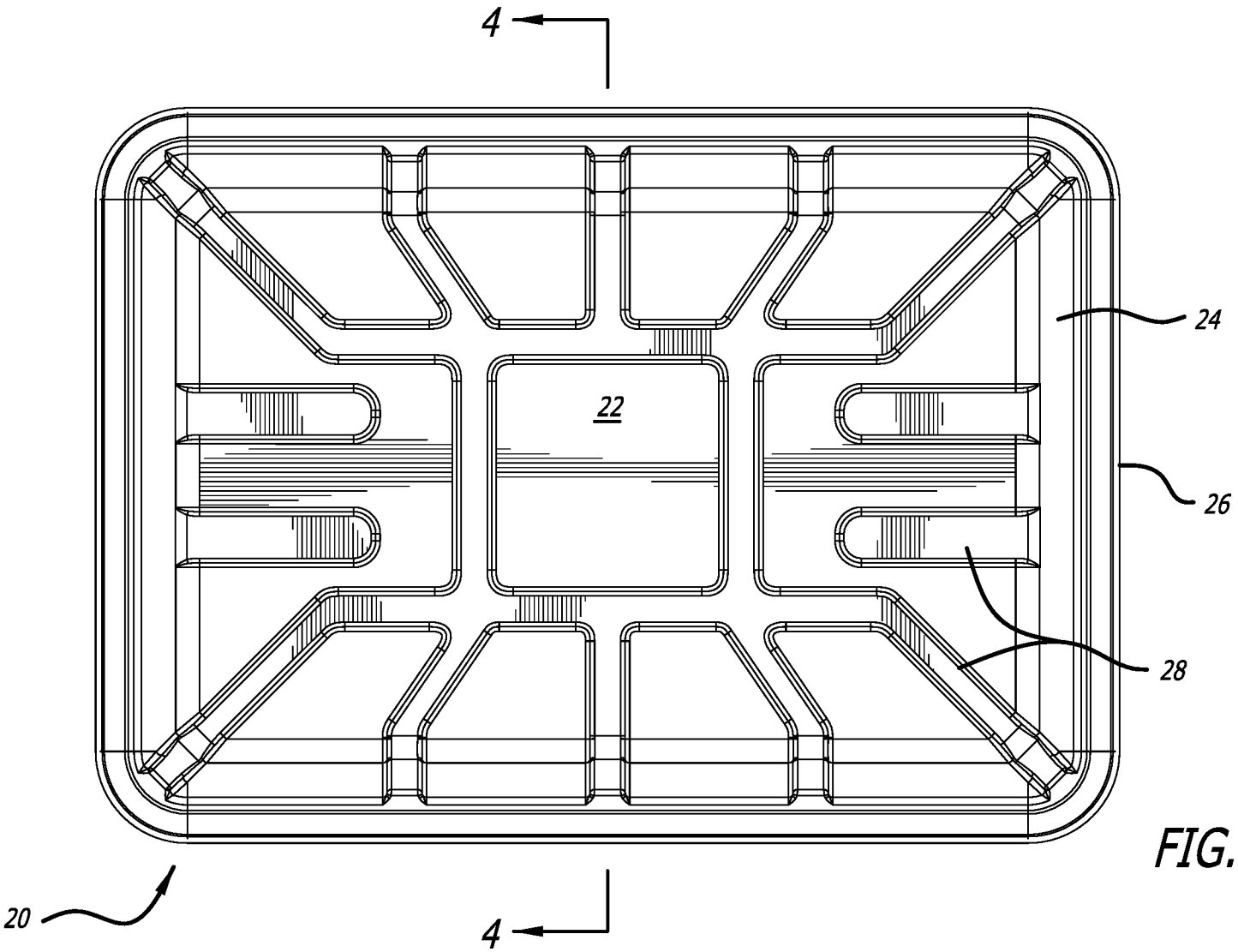
FIGS. 3A and 3B are top and bottom plan views, respectively, of the rectangular food tray container.
Figure 3B:
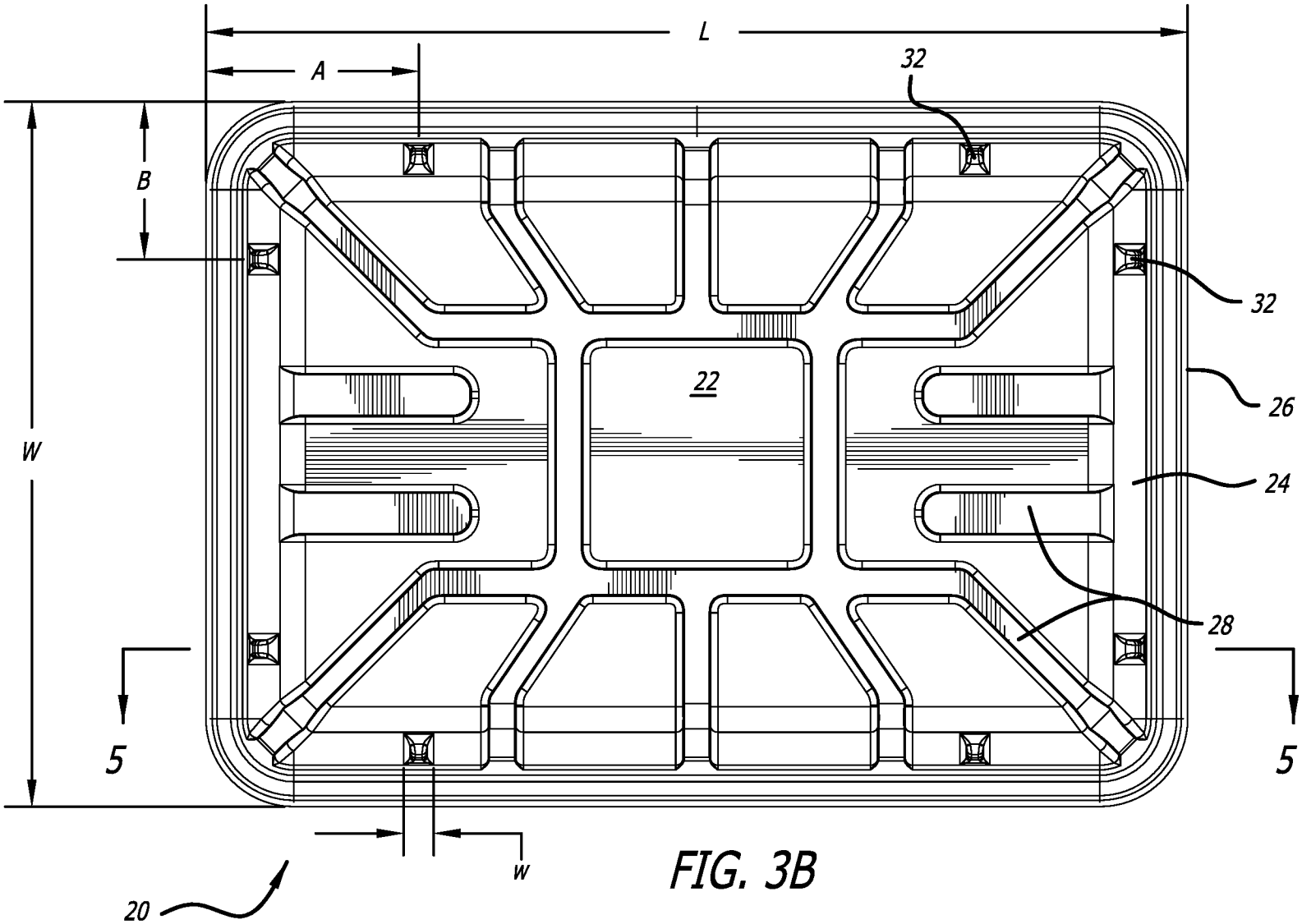

FIGS. 3A and 3B are top and bottom plan views, respectively, of the rectangular food tray container 20, with FIG. 3B indicating exemplary dimensions. In particular, the container 20 has a length L and a width W. The lugs 32 are desirably symmetric across the perpendicular major planes of the container 20. That is, there are two lugs 32 on each of the long sidewalls 24 across from two lugs at the same locations on the opposite long sidewall, and two lugs 32 on each of the short sidewalls 24 across from two lugs at the same locations on the opposite long short sidewall. Each of the lugs 32 is shown spaced a distance A or B from the nearest corner of the container 20, depending on whether it is on a long or short sidewall 24. It should be noted that the "corners" in this sense means projections from the adjacent perpendicular sides, as the actual corners are rounded per convention. The length L and width W dimensions may vary, with one example being L=8.82 in and W=6.33 in.

The spacing distances A or B from the nearest corner may also vary, but in one embodiment are A=1.90 in and B=1.40 in. Another way to quantify these dimensions is that the two lugs 32 are no less than ⅕ of the total dimension of the respective sidewall from the corner, and no greater than ⅓ from the corner, or $0.2L<A<0.33L$ and $0.2B<B<0.33W$.

FIG. 3B also indicates a width w of one of the lugs 32 on a sidewall 24. Each lug 32 has a width w of at least 0.2 inches, such as between about 0.2-0.5 inches, primarily due to the process of formation, wet pressing, described below. That is, wet pressing cannot create narrow ribs, but instead is only capable of forming wider depressions and bumps of a minimum width. Though the lugs 32 could be wider than 0.5 inches, such as up to 1.0 inches, they are preferably 0.5 inches or less.

It should be understood that although two lugs 32 are considered adequate and preferable for even stacking of the containers 20, a single lug 32 at the center of each sidewall may also be utilized, or more than two lugs may be provided per side. Moreover, the peripheral shape of the container may dictate the number of lugs. For example, if the container is circular, as opposed to rectilinear, there should be at least three of the lugs to provide a tripod of sorts for one container to nest within another while maintaining the desirable axial spacing. Likewise, if the container is triangular and peripheral shape, three lugs may be suitable, or two on each side of the triangle for a total of six. In summary, there are desirably at least three lugs for each contain regardless of shape, and for rectilinear or otherwise polygonal peripheral shapes, there may be at least one lug per side. However, a hexagonal container might have six lugs, one per side, or it may be adequate to have just one lug on each of three sides, in an alternating pattern of one lug on first, third, and fifth sides.

Figure 4:
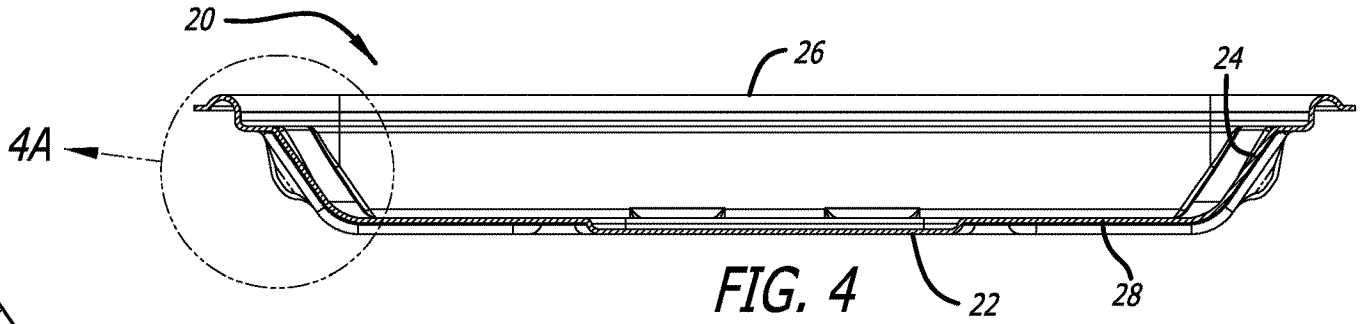
FIG. 4 is a sectional view through the center of the food tray container across a width dimension, taken along line 4-4 of FIG. 3A.
Figure 5A:
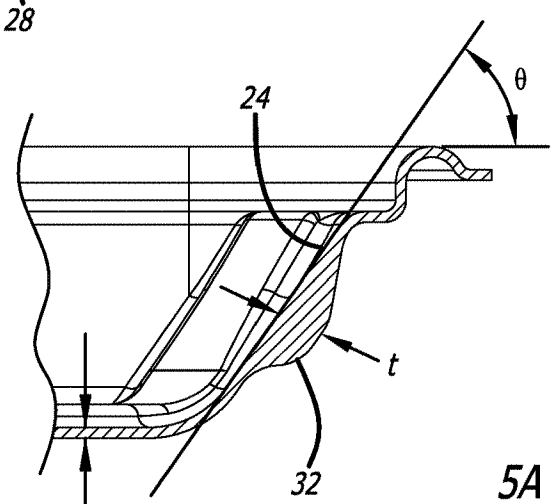
FIG. 5A is an enlargement of one sidewall thereof.
Figure 4A:
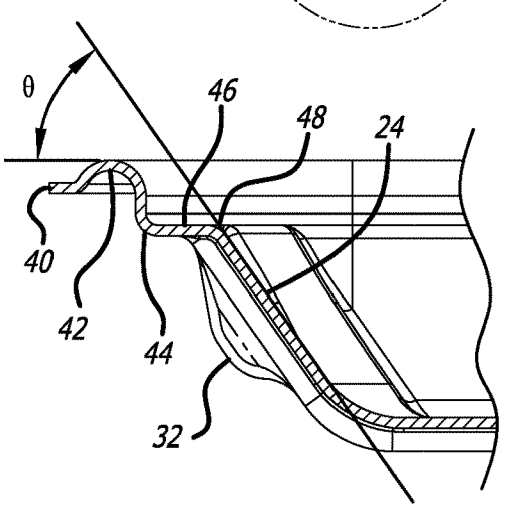
FIG. 4A is an enlargement of one sidewall thereof.
Figure 5:
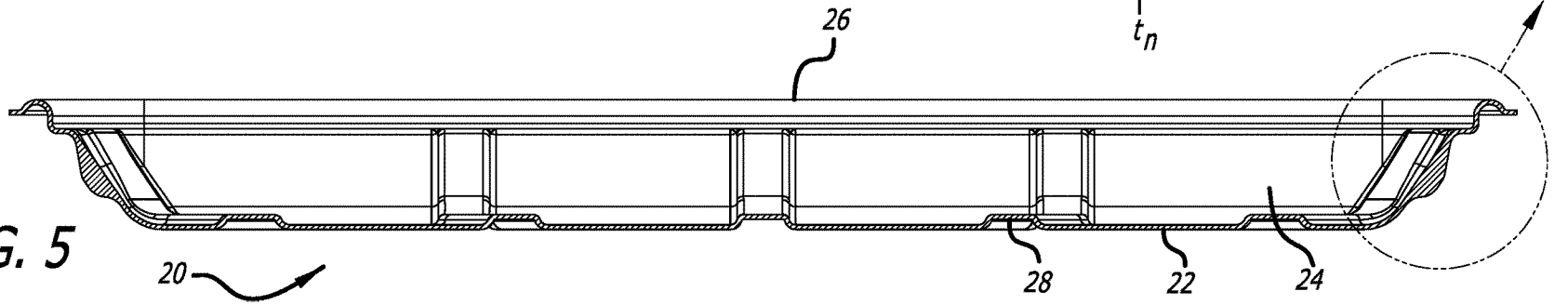
FIG. 5 is a sectional view through the center of the food tray container across a length dimension, taken along line 5-5 of FIG. 3B.

FIG. 4 is a sectional view through the center of the food tray container 20 across a width dimension, taken along line 4-4 of FIG. 3A, and FIG. 4A is an enlargement of one sidewall thereof, while FIG. 5 is a sectional view through the center of the food tray container across a length dimension, taken along line 5-5 of FIG. 3B, and FIG. 5A is an enlargement of one sidewall thereof. The surrounding lip 26 is desirably molded to have a somewhat serpentine configuration in cross-section to provide stiffness and also present a prominent feature to grab and manipulate the container 20. In particular, FIG. 4A shows that, from out to in, the lip 26 includes an outer generally horizontal flange 40 contiguous with a somewhat semi-circular upward bend 42 which transitions downward to a right-angle curve 44. The curve 44 leads to an inwardly-directed ledge 46 and then a rounded corner 48 just before dropping down into the container along the angled sidewall 24. The upward bend 42 provides a convenient location to wish to attach a transparent plastic wrap for enclosing the contents of the container 20. The horizontal flange 40 provides a convenient location enabling grasping separating nested trays from each other.

With reference in particular to FIG. 5A, the lugs 32 are solid and thicker than the nominal thickness dimension of the rest of the tray container 20. In one embodiment, the tray container 20 comprises a molded quantity of material (e.g., fiber) resulting in a nominal thickness of between about 0.6 mm to 0.7 mm. The thickness t of each of the lugs 32, on the other hand, is between about 3-5 times the nominal wall thickness of the container 20. In one example, for a nominal container wall thickness of 0.7 mm, the thickness t of each of the lugs 32 is 3.0 mm. Stated in a more generic way to accommodate inwardly-directed lugs, each lug is thicker from a projecting surface to a base surface on an opposite face of the sidewall than the nominal wall thickness of the container 20. In the embodiment of FIG. 5A, the projecting surface is outward while the base surface is on the inside of the sidewall 24, and t shows the thickness.

Importantly, each of the lugs 32 only projects outward from the respective sidewall 24. That is, the inner surface of the sidewall 24 seen in FIG. 5A has a flat or planar configuration, while the outer surface of the lugs 32 is rounded, somewhat teardrop shaped. Because the lugs 32 are symmetrically located on each of the containers 20, when a first container is stacked within a second container the outer surface of each of the lugs 32 of the first container contacts the planar inner surface of the corresponding sidewall on the second container into which it is nested. This prevents the first container from settling all the way down into the second container, resulting in a preferred axial spacing.

Figure 6:
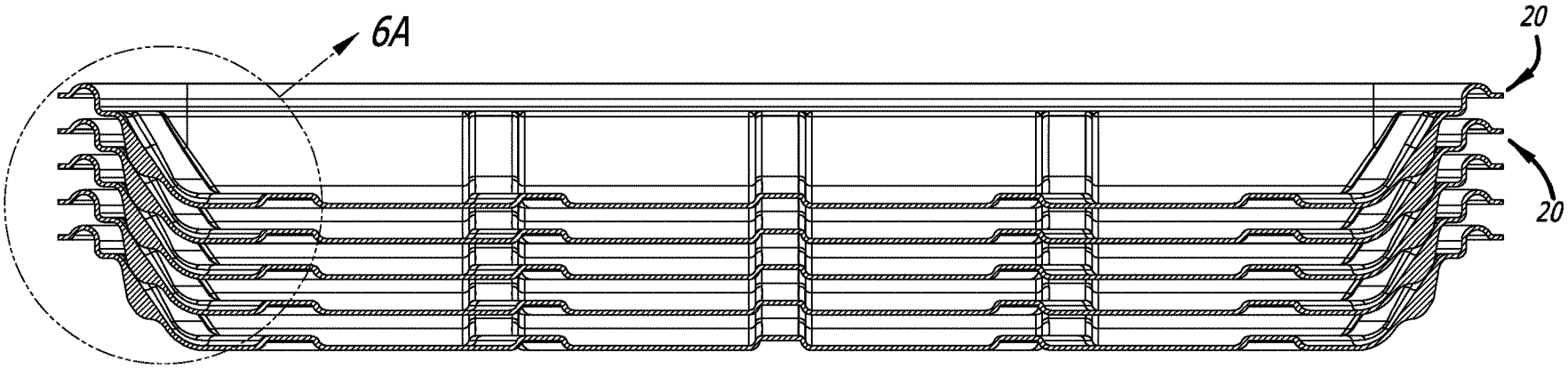
FIG. 6 is a sectional view of a plurality of food tray containers across a length dimension stacked and nested.
Figure 6A:
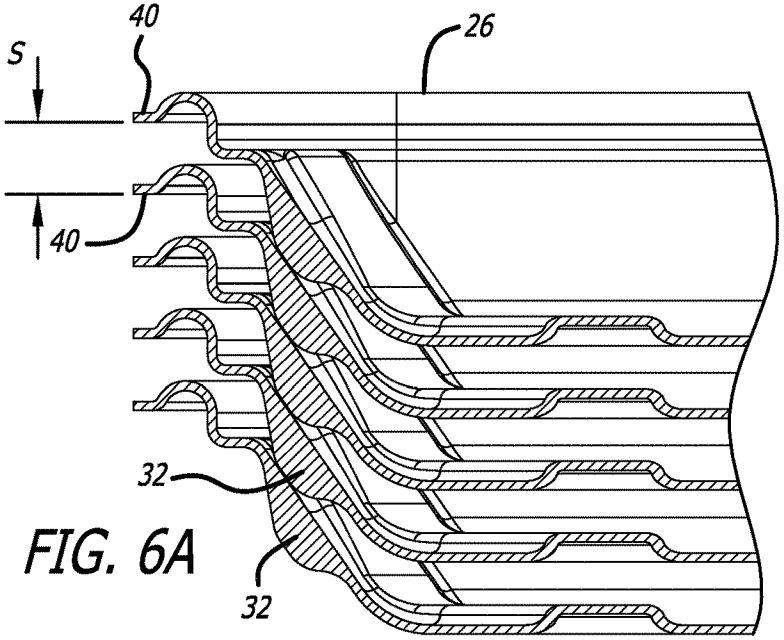
FIG. 6A is an enlargement of the stacked sidewalls thereof.

FIG. 6 is a sectional view of a plurality of food tray containers 20 across a length dimension stacked and nested. FIG. 6A is an enlargement of the stacked sidewalls thereof, showing adjacent lips 26, and in particular adjacent horizontal flanges 40 separated by an axial space S. The axial spacing S is created by contact between the lugs 32 of each container with the inner surface of the corresponding sidewall on the next adjacent container below, as shown. The particular magnitude of the axial spacing S may vary depending on needs of the food producer or handler, but is preferably between about 5-6 mm. The magnitude of the axial spacing S depends on several factors, most notably the thickness t of each of the lugs 32, but also the angle of the sidewall 24.

With reference back to FIG. 5A, a so-called draft angle Θ is shown for the sidewalls 24 on both the long and short sides of the container 20. Because the shape of the sidewalls 24 is identical around the entire container, the draft angles Θ and lugs 32 on all four sides are also identical. In one embodiment, the draft angle Θ is between about 30-35°. To ensure one particular axial spacing S of 5 mm, the draft angle Θ is 35° and the thickness t of each lug 32 is 2.5 mm.

Figure 7:
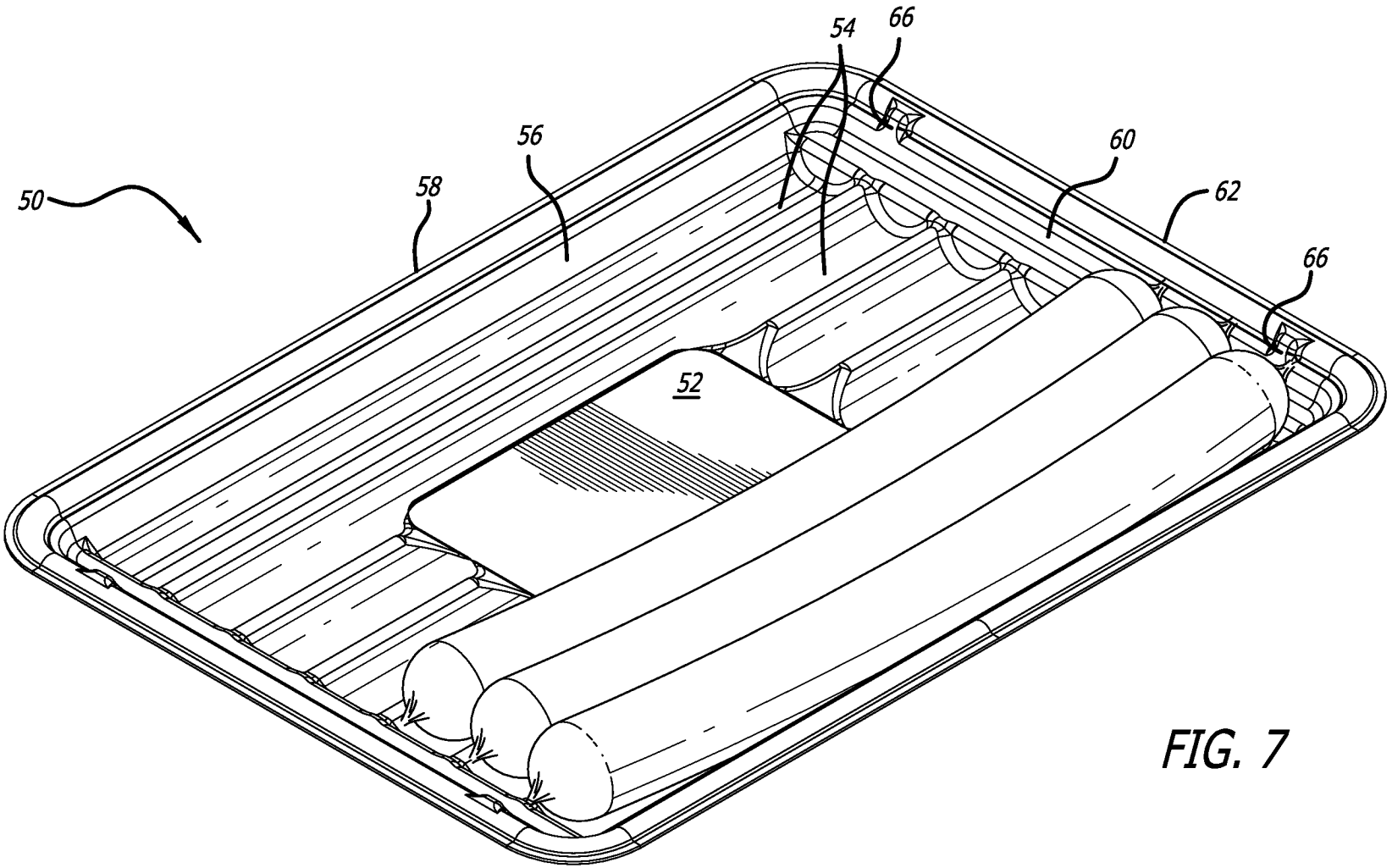
FIG. 7 is a perspective view from above of an alternative rectangular food tray container of the present application.
Figure 8:
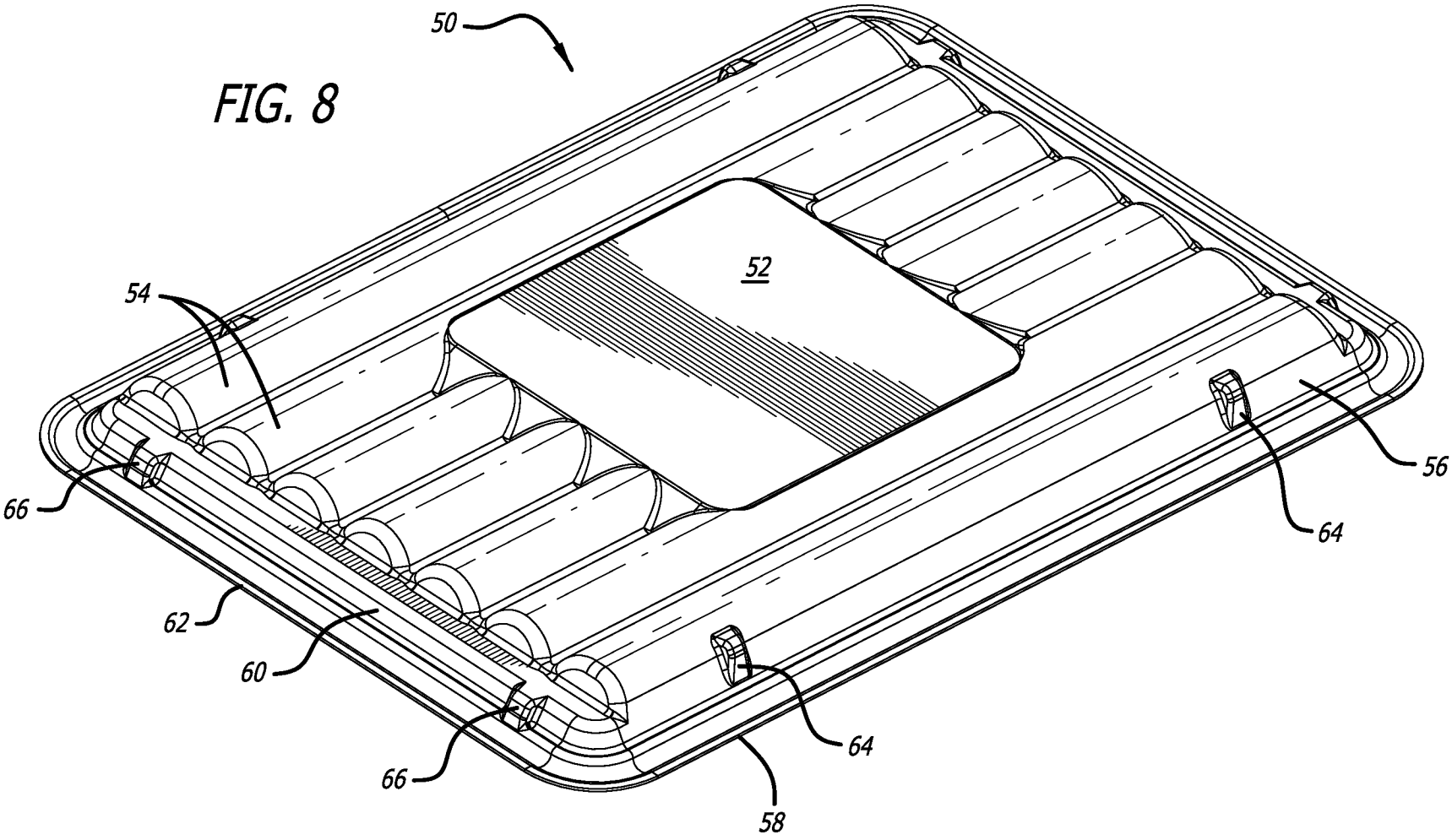
FIG. 8 is a perspective view of the food tray container from below.

FIG. 7 is a perspective view from above of an alternative rectangular food tray container 50 of the present application, and FIG. 8 is a perspective view of the food tray container from below. As with the first described food tray container 20, the alternative container 50 has a rectangular configuration with a length dimension and a shorter width dimension. The container 50 has a floor with a central flat portion 52 surrounded by a plurality of longitudinal troughs 54. Two opposed long dimension sidewalls 56 lead upward to peripheral lips 58, while two opposed short dimension sidewalls 60 lead upward to peripheral lips 62. As with the first container, the peripheral lips 58, 62 continuously surround and define an upper extent of a food-containing cavity within the container 50, and are joined at rounded corners. The longitudinal troughs 54 comprise semi-cylindrical molded shapes for receiving food items, such as sausages or hotdogs as shown. The troughs 54 extend the length of the container 50, except as interrupted by the central flat portion 52 which provides a convenient location for applying an external label to the bottom of the container.

The sidewalls 56, 60 of the container 50 once again feature outwardly-directed lugs 64, 66 to ensure a minimum axial spacing between adjacent containers when they are stacked or nested. In contrast to the first embodiment, the long sidewalls 56 and short sidewall 60 are not identically-configured so that the lugs 64, 66 are also not the same.

Figure 9A:
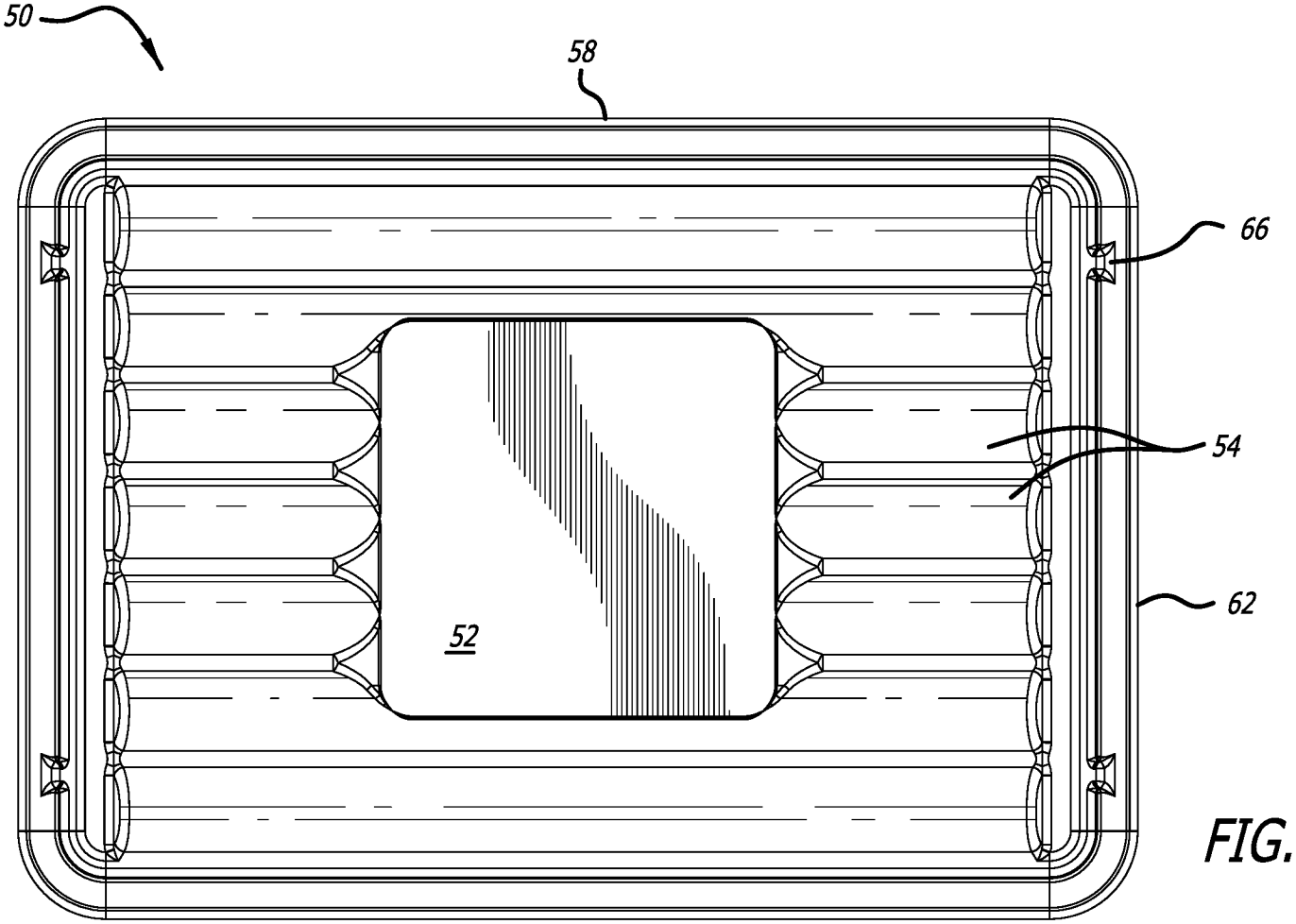
FIGS. 9A and 9B are top and bottom plan views, respectively, of the alternative rectangular food tray container.
Figure 9B:
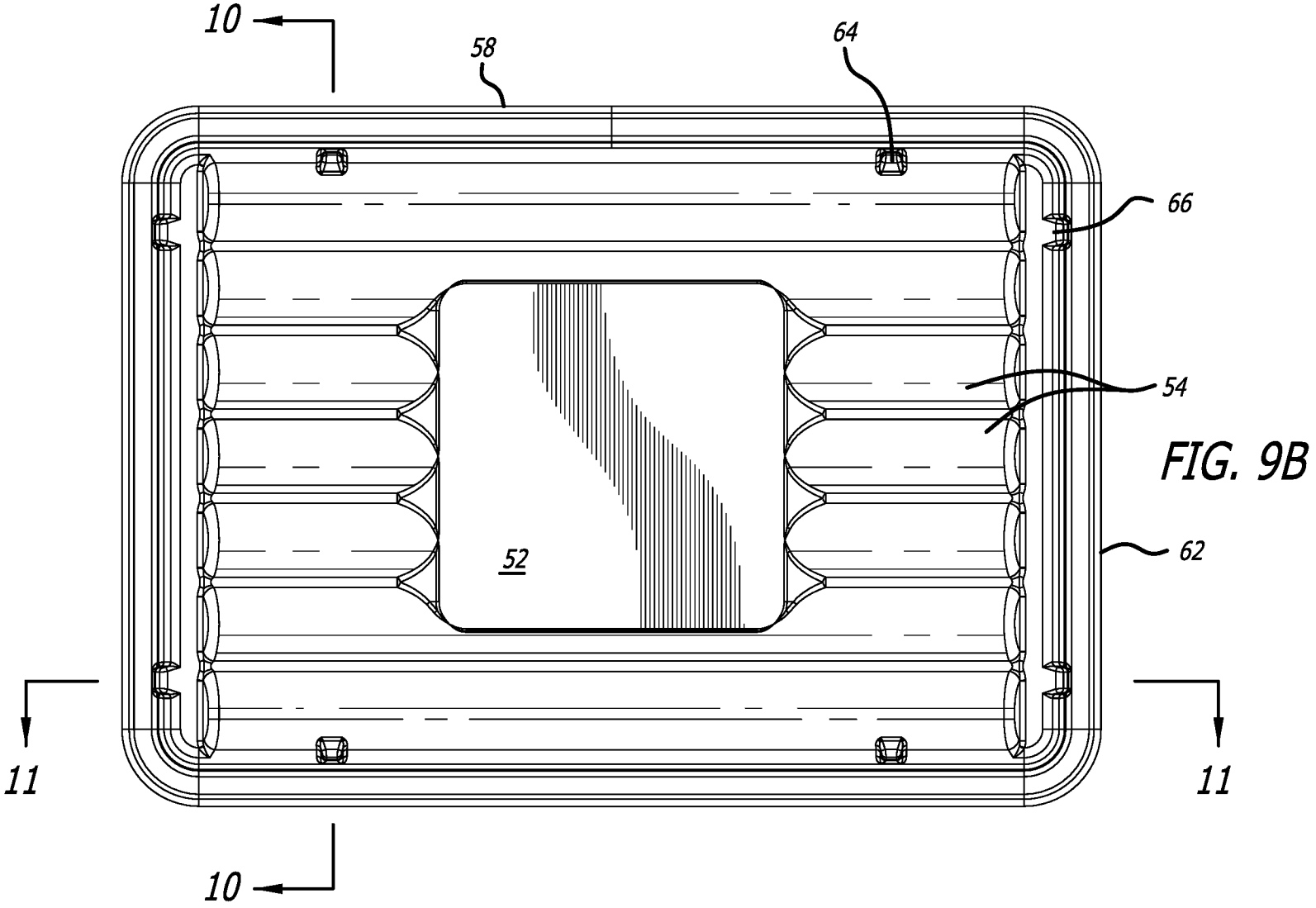

FIGS. 9A and 9B are top and bottom plan views, respectively, of the alternative rectangular food tray container 50. Although not shown, the nominal wall thickness and rectangular dimensions of the container 50 may be the same as described above for the first container 20, and thus will not be repeated.

Figure 10:
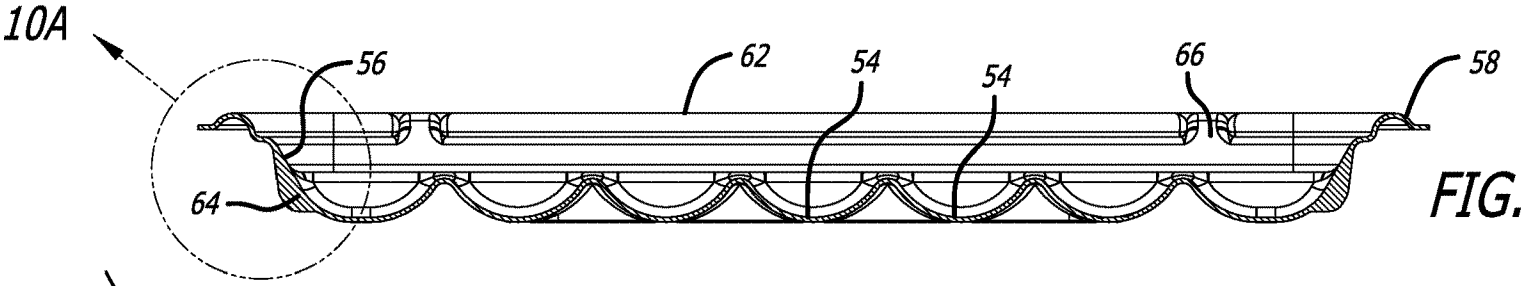
FIG. 10 is a sectional view through the center of the alternative food tray container across a width dimension, taken along line 10-10 of FIG. 9A.
Figure 11A:
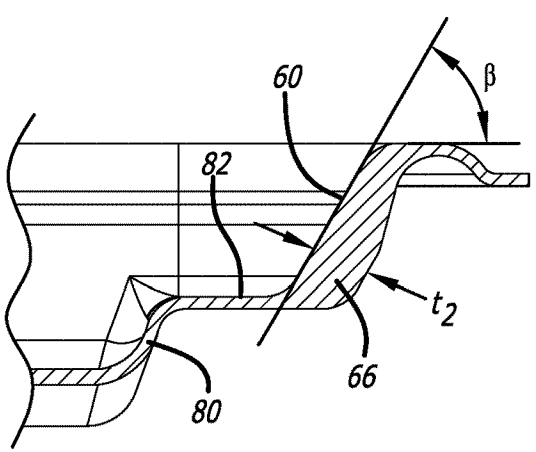
FIG. 11A is an enlargement of one sidewall thereof.
Figure 11:
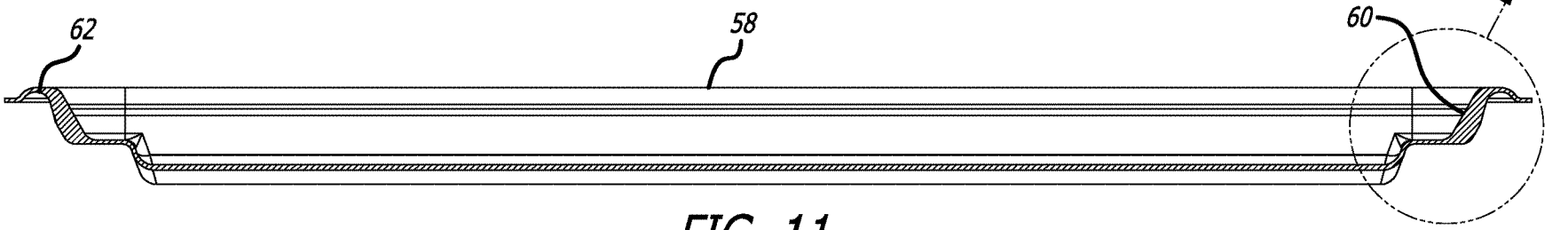
FIG. 11 is a sectional view through the center of the alternative food tray container across a length dimension, taken along line 11-11 of FIG. 9B.

FIG. 10 is a sectional view through the center of the alternative food tray container 50 across a width dimension, taken along line 10-10 of FIG. 9A, and FIG. 11 is a sectional view through the center of the alternative food tray container across a length dimension, taken along line 11-11 of FIG. 9B. The configuration of the semi-cylindrical troughs 54 are seen in FIG. 10, which also shows the long sidewalls 56 extending upward generally at a constant angle to the upper lips 58. FIG. 11, on the other hand, shows a stepped configuration for the short sidewalls 60 leading upward to the upper lips 62. This illustrates the concept that the various sidewalls around the containers as described herein may be the same or different.

Figure 10A:
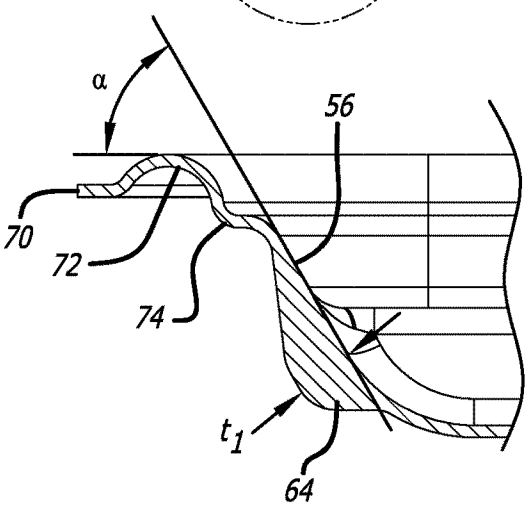
FIG. 10A is an enlargement of one sidewall thereof.

FIG. 10A is an enlargement of one long sidewall 56 of the container 50. As with the earlier embodiment, an inner surface of the sidewall 56 is relatively flat and uninterrupted, while the lugs 64 project outward in solid bulges, which are somewhat teardrop shaped in section. The thickness $t_1$ of the lugs 64 at an angle perpendicular to the inner surface of the sidewall 56 is desirable between about 3-5 times the nominal wall thickness of the remainder of the sidewalls, and for that matter for the remainder of the container 50. Specific ranges and exemplary dimensions provided above for the first exemplary container 20 may be utilized and therefore will not be repeated here. A sidewall draft angle α is shown and may also be as described above for the first embodiment.

The upper lip 58 once again has a somewhat serpentine configuration with an outward horizontal flange 70 contiguous with a somewhat semi-circular upward bend 72 which transitions downward to a right-angle curve 74. The curve 74 leads to an inwardly-directed ledge and then a rounded corner just before dropping down into the container along the angled sidewall 56. Again, this configuration provides stiffness and an outer handle for manipulating the container 50, much like that described above.

FIG. 11A is an enlargement of one short sidewall 60 illustrating the indented or stepped nature at the lugs 66 in contrast to the constant cross-section of the long sidewall 56 in FIG. 10A. In particular, a short upward step 80 is provided between the floor troughs 54 and the upwardly and outwardly angled sidewall 60 so as to create intermediate ledges 82 therebetween. The short sidewalls 60 have draft angles β which may be the same as or different than the draft angle α of the long sidewalls 56. The draft angles β are desirably within a range as described above for the sidewalls 24 of the first container 20.

Each short sidewall 60 has two outwardly directed lugs 66 that project outward from the angled inner surface of the sidewall 60. More particularly, each lug 66 has a thickness $t_2$ that is greater than the nominal wall thickness of the surrounding portions of the sidewall 60, and for that matter than the wall thickness of the rest of the container (except for the other lugs 64). The thickness $t_2$ of each lug 66 may be the same as or different than the thickness $t_1$ of the lugs 64. In one embodiment, the draft angles β of the short sidewalls 60 are the same as the draft angle α of the long sidewalls 56, and the thicknesses are the same ($t_1=t_2$).

The lugs 66 that project outward from the short sidewalls 60 as seen in cross-section in FIG. 11A are constructed slightly differently than the lugs 64 on the long sidewalls 56, which are seen in FIG. 10A. That is, the stepped wall shape with the intermediate ledges 82 are only present at the location of the lugs 66, such that the lugs may be seen from the inside of the container 50, as in FIG. 7. In other words, the lugs have both an internal concavity and an external convexity. Despite this, the lugs 66 are not simply outward bows in the sidewalls 60 due to the increased thickness $t_2$ that is greater than the nominal wall thickness of the surrounding portions of the sidewall 60. The increased thickness $t_2$ helps create the spacing S between adjacent containers 50 when stacked, along with the wholly outwardly convex lugs 64 on the long sidewalls 56. In other words, the lugs may be wholly outwardly projecting or a combination of outwardly projecting and inwardly recessed. The spacing S between adjacent containers 50 is a result of one type of lug or a combination of both.

A generally linear relationship exists between the draft angles and the thicknesses of the various lugs to ensure a predetermined axial spacing between nested containers 50. That is, due to the innate geometry, steeper sidewalls/greater draft angles require thicker lugs to result in the same axial spacing as center lugs on shallower sidewalls/lesser draft angles. Therefore, for example, if the draft angle α of the long sidewalls 56 is less than the draft angles β of the short sidewalls 60, then the thickness $t_1$ of the lugs 64 is necessarily less than the thickness $t_2$ of each lug 66 so as to result in equal contact between the lugs 64, 66 and the adjacent containers 50. A variety of permutations are contemplated.

Figure 12:
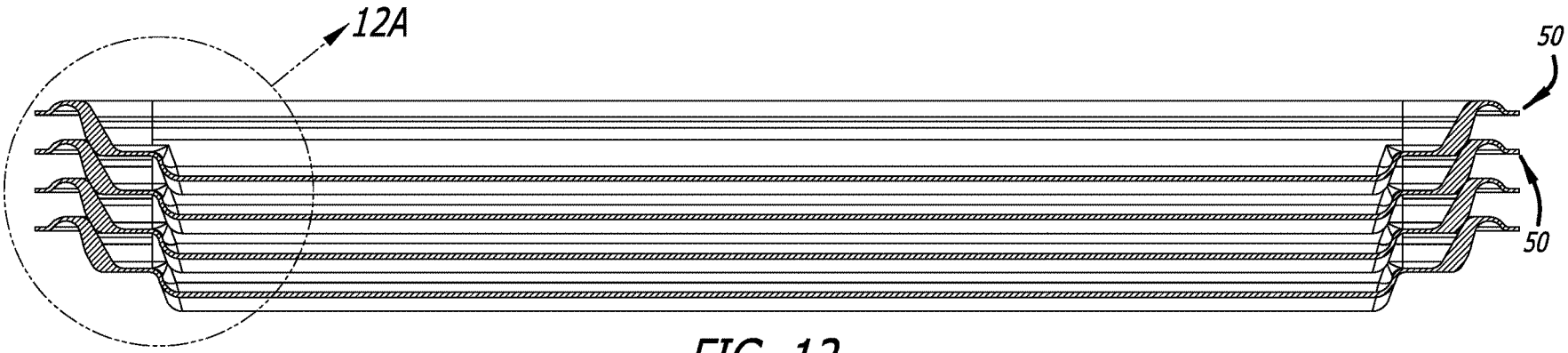
FIG. 12 is a sectional view of a plurality of alternative food tray containers across a length dimension stacked and nested.
Figure 13:
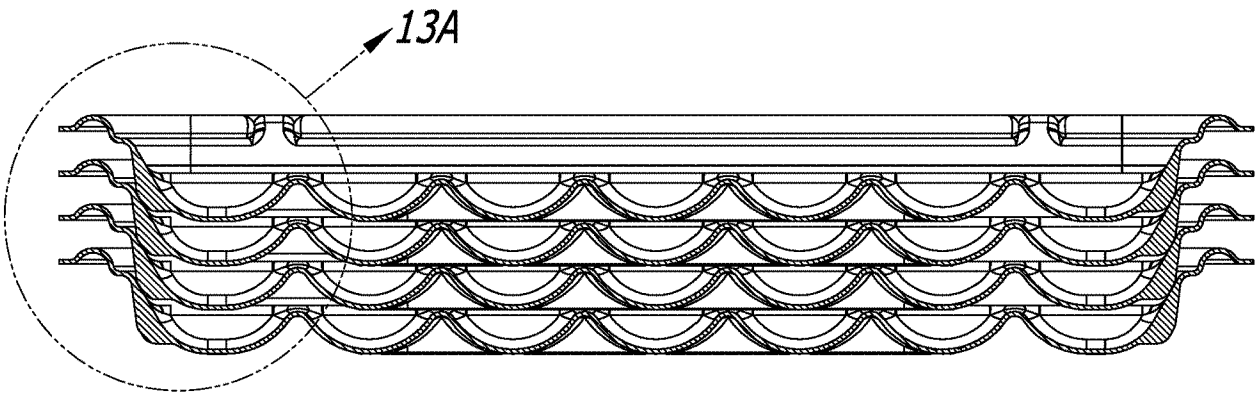
FIG. 13 is a sectional view of a plurality of alternative food tray containers across a width dimension stacked and nested.
Figure 13A:
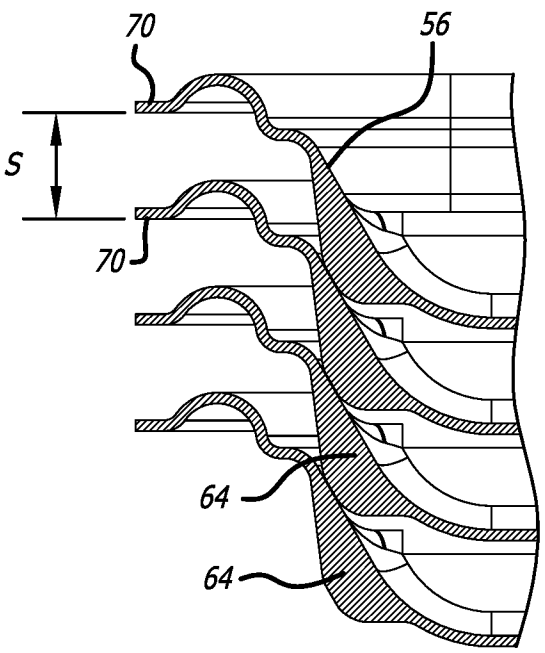
FIG. 13A is an enlargement of the stacked sidewalls thereof.
Figure 12A:
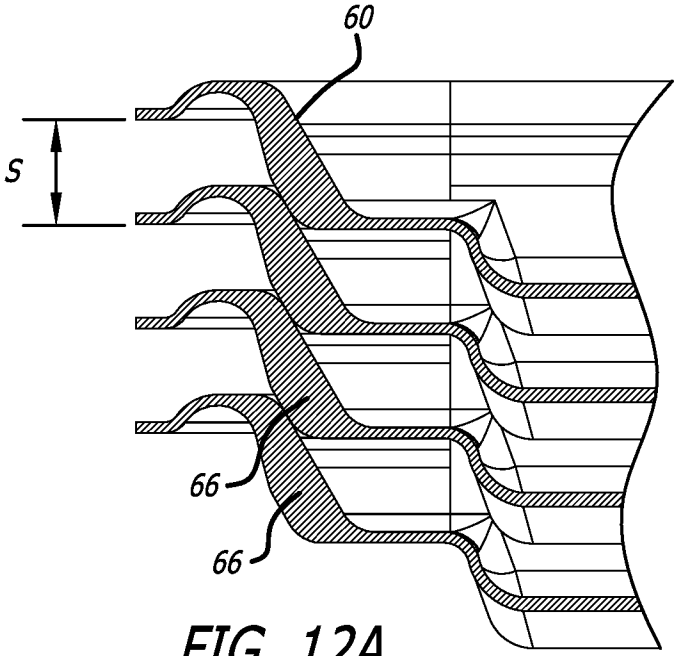
FIG. 12A is an enlargement of the stacked sidewalls thereof.

FIG. 12 is a sectional view of a plurality of alternative food tray containers 50 across a length dimension stacked and nested, and FIG. 12A is an enlargement of the stacked short sidewall 60 thereof. Likewise, FIG. 13 is a sectional view of a plurality of alternative food tray containers 50 across a width dimension stacked and nested, and FIG. 13A is an enlargement of the stacked long sidewalls 56 thereof. Contact between the respective lugs 64, 66 and the inner surface of the sidewall 56, 60 there below is shown. As explained above, the configuration of the sidewalls and lugs are such that the resulting spacing S remains constant around the container 50. Once again, the spacing S may vary depending on need, and exemplary ranges are provided above for the first container 20.

Figure 14:
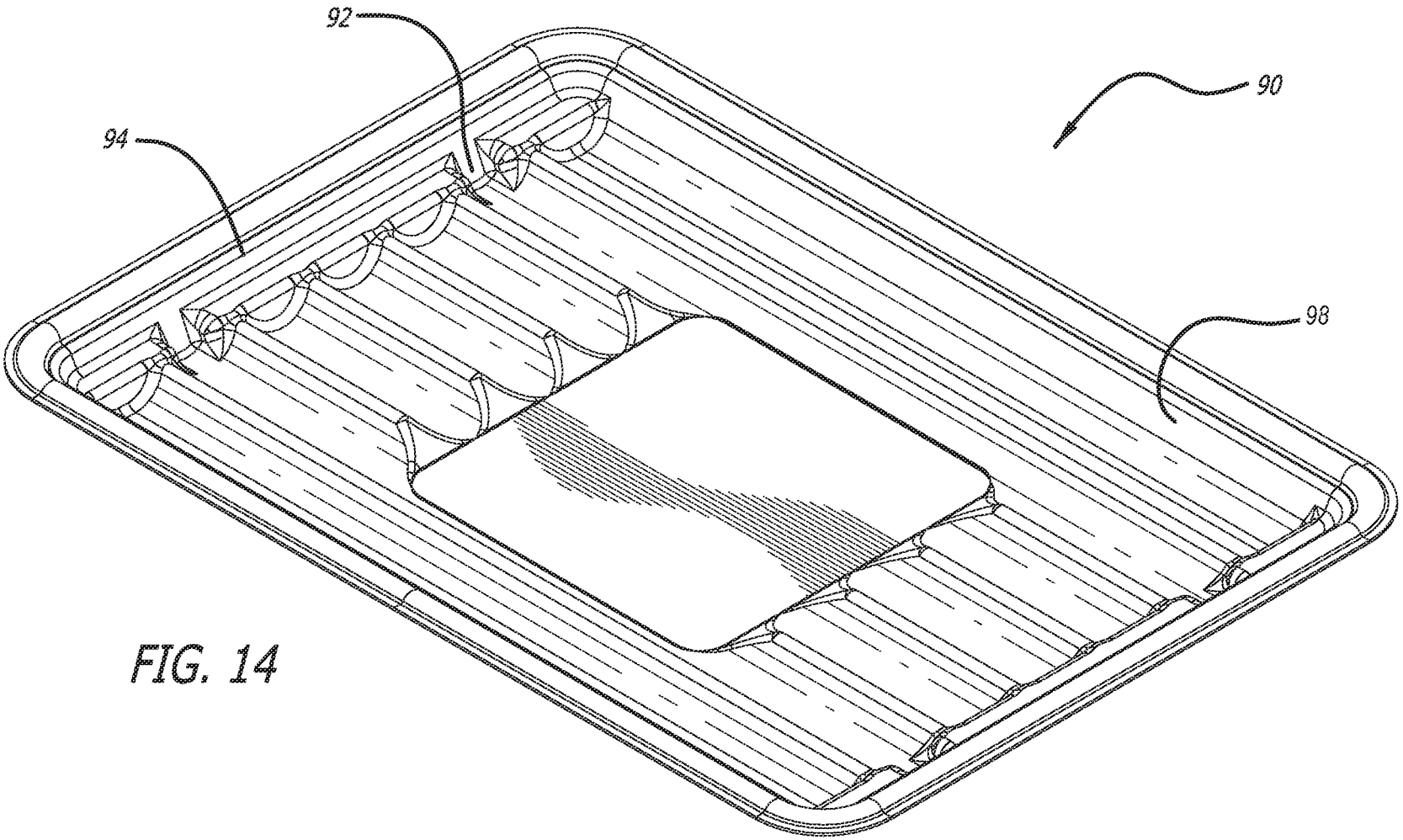
FIG. 14 is a perspective view from above of a still further alternative rectangular food tray container of the present application.
Figure 15:
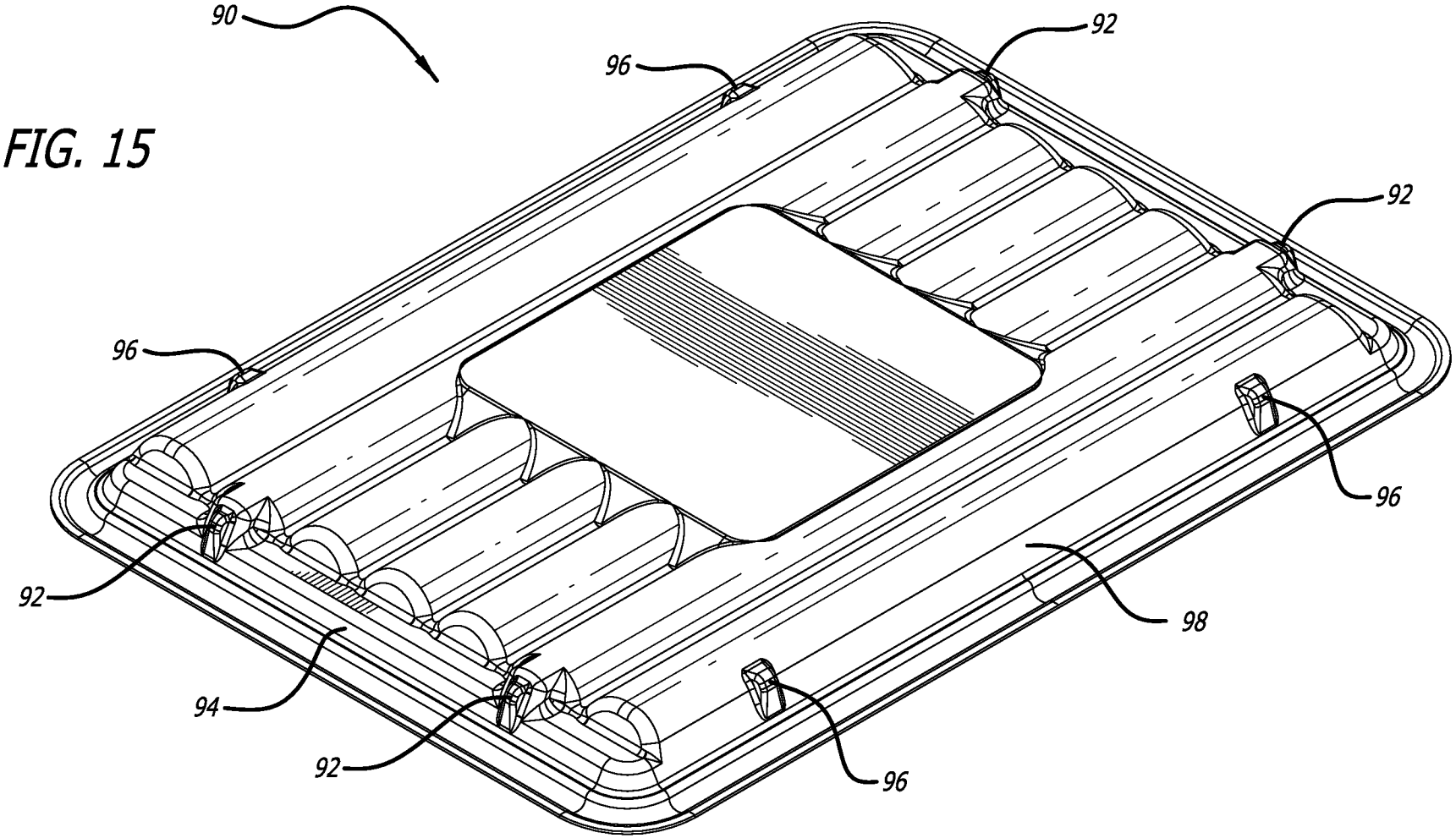
FIG. 15 is a perspective view of the food tray container from below.

FIG. 14 is a perspective view from above of a still further alternative rectangular food tray container 90 of the present application, and FIG. 15 is a perspective view of the food tray container from below. In most respects, the alternative container 90 is constructed the same as the container 50, and the description of above of common features applies. The difference is in placement of lugs 92 on the short sidewalls 94. That is, the lugs 92, which are both outwardly projecting and inwardly recessed as with the lugs 66 described earlier, are located lower down on the sidewalls 94, closer to the floor of the container. Indeed, the lugs 92 form a part of the floor. A comparison between FIGS. 7 and 14 shows this difference. The placement of the outward lugs 96 on the longer sidewalls 98 remain the same as the lugs 64 on the container 50. The lugs 96 are wholly outwardly projecting as well.

Figure 16:
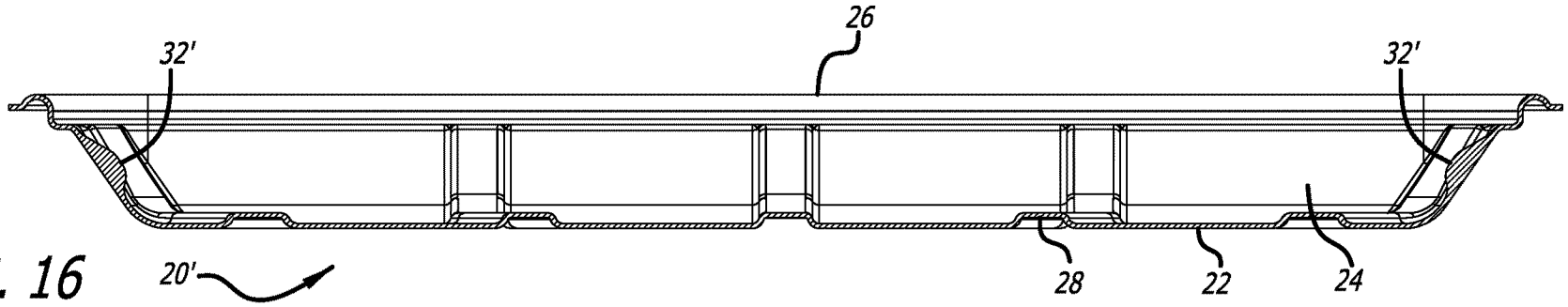
FIG. 16 is a sectional view through the center of a further alternative food tray container across a length dimension.
Figure 16A:
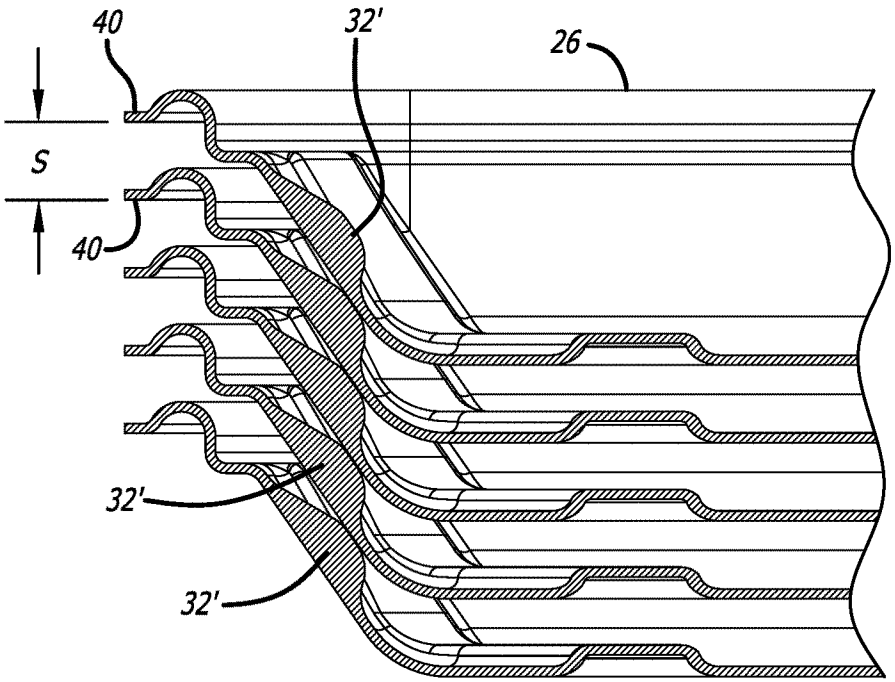
FIG. 16A is a sectional view of a plurality of the alternative food tray containers across a length dimension stacked and nested.

FIG. 16 is a sectional view through the center of a further alternative food tray container 20' across a length dimension, and FIG. 16A is a sectional view of a plurality of the alternative food tray containers stacked and nested. In this version, the container 20' has a plurality of inwardly projecting lugs 32' in each of the sidewalls 24 that serve to maintain an axial distance between a series of the stacked containers. The number and spacing of the inwardly projecting lugs 32' may be as described above for the earlier embodiments. The inwardly projecting lugs 32' serve the same purpose as the outwardly projecting lugs 32—to provide spacing S between the stacked containers 20', as shown in FIG. 16A. In this embodiment, the each lug is thicker from a projecting surface (inner extend of lugs 32') to a base surface on an opposite face of the sidewall (exterior of sidewall 24).

Unless otherwise indicated or the context suggests otherwise, as used herein, "a" or "an" means "at least one" or "one or more."

Furthermore, unless otherwise stated, any specific dimensions mentioned in this description are merely representative of an exemplary implementation of a device embodying aspects of the invention and are not intended to be limiting.

While the present invention has been described and shown in considerable detail with reference to certain illustrative embodiments, including various combinations and sub-combinations of features, those skilled in the art will readily appreciate other embodiments and variations and modifications thereof as encompassed within the scope of the present invention. Moreover, the descriptions of such embodiments, combinations, and sub-combinations is not intended to convey that the invention requires features or combinations of features other than those expressly recited in the claims. Accordingly, the present invention is deemed to include all modifications and variations encompassed within the spirit and scope of the following appended claims.

It is claimed:

1. A food container system, including:

a wet press molded container of solid continuous construction of fibrous material, the container having a floor and contiguous upstanding sidewalls angling outward and upward to a surrounding upper lip, the floor and sidewalls surrounding an inner cavity below the upper lip adapted to receive food, wherein the sidewalls include at least three lugs that project from adjacent sidewalls and are thicker from a projecting surface to a base surface on an opposite face of the sidewall than a nominal wall thickness of adjacent sidewalls, each lug being a rounded bulge having a thickness (t) of between 3-5 times the nominal wall thickness of the sidewalls and having a lateral width of at least 0.2 inches and no more than 1 inch, wherein at least some of the lugs are located along a corresponding sidewall vertically spaced from an associated upper lip portion, wherein a first molded container may be stacked within a second molded container such that the lugs on the first container contact the inner surface of the second container at the location of the lugs on the second container and maintain a predetermined axial spacing between the first and second containers.

2. The food container system of claim 1, wherein the container is rectangular and has four sidewalls each having at least one of the lugs.

3. The food container system of claim 2, wherein each of the sidewalls has two of the lugs spaced apart closer to adjacent corners than each other.

4. The food container system of claim 2, wherein each of the sidewalls has two of the lugs, and wherein a first pair of sidewalls opposite one another have lugs with base surfaces which are contiguous and uninterrupted relative to the surface of adjacent portions of the sidewall.

5. The food container system of claim 4, wherein a second pair of sidewalls opposite one another have lugs with base surfaces which are indented or stepped relative to the surface of adjacent portions of the sidewall.

6. The food container system of claim 1, wherein the nominal wall thickness of the sidewalls is between 0.6 mm and 0.7 mm.

7. The food container system of claim 1, wherein each lug has a lateral width of between 0.2-0.5 inches.

8. The food container system of claim 1, wherein the lugs project outward from the sidewalls.

9. A food container system, including:

a wet press molded rectangular container of solid continuous construction of fibrous material, the container having a floor and four contiguous upstanding sidewalls angling outward and upward to a surrounding upper lip, the floor and sidewalls surrounding an inner cavity below the upper lip adapted to receive food, wherein the sidewalls include at least one outwardly projecting lug in each sidewall that are each thicker from an inner surface to an outer surface thereof than a nominal wall thickness of adjacent sidewalls, each lug being a rounded bulge having a thickness (t) of between 3-5 times the nominal wall thickness of the sidewalls and having a lateral width of at least 0.2 inches and no more than 1 inch, wherein at least some of the lugs are located along a corresponding sidewall vertically spaced from an associated upper lip portion, wherein a first molded container may be stacked within a second molded container such that the lugs on the first container contact the inner surface of the second container at the location of the lugs on the second container and maintain a predetermined axial spacing between the first and second containers.

10. The food container system of claim 9, wherein each of the sidewalls has two of the lugs spaced apart closer to adjacent corners than each other.

11. The food container system of claim 10, wherein the lugs are spaced apart from adjacent corners no less than ⅕ and no greater than ⅓ of the total dimension of the respective sidewall from the corner.

12. The food container system of claim 9, wherein each of the sidewalls has two of the lugs, and wherein a first pair of sidewalls opposite one another have lugs with inner surfaces which are contiguous and uninterrupted relative to the inner surface of adjacent portions of the sidewall.

13. The food container system of claim 12, wherein a second pair of sidewalls opposite one another have lugs with inner surfaces which are indented or stepped relative to the inner surface of adjacent portions of the sidewall.

14. The food container system of claim 9, wherein the nominal wall thickness of the sidewalls is between 0.6 mm and 0.7 mm.

15. The food container system of claim 9, wherein each lug has a lateral width of between 0.2-0.5 inches.

* * * * *